US006161496A

United States Patent [19]

Fulks

[11] Patent Number: 6,161,496

[45] **Date of Patent: *Dec. 19, 2000**

[54] BOAT WITH INTEGRATED FLOOR AND STRINGER SYSTEM AND ASSOCIATED METHOD OF MANUFACTURING

[76] Inventor: Jimmy J. Fulks, 1392 Howard La., Marion, Ill. 62959

[ * ] Notice: This patent is subject to a terminal disclaimer.

[21] Appl. No.: 09/455,758

[22] Filed: Dec. 7, 1999

Related U.S. Application Data

[62] Division of application No. 08/955,777, Oct. 22, 1997, Pat. No. 6,032,606.

[51] Int. Cl.[7] ..... B63B 5/24

[52] U.S. Cl. ..... 114/357; 114/85; 114/65 R

[58] Field of Search ..... 114/355–357, 65 R, 114/82, 85, 78

*Primary Examiner*—Ed Swinehart

*Attorney, Agent, or Firm*—Brij K. Agarwal; Arnold B. Silverman; Eckert Seamans Cherin & Mellott, LLC

[57] ABSTRACT

A boat includes a hull and a unique integrated, molded, floor and stringer system for positioning in the hull for providing structural support and stiffening thereto. The floor and stringer system may include first and second stringers and at least two bulkheads extending therebetween. The first and second stringers include a floor surface integrally molded therewith so that once the floor and stringer system is positioned in the interior of the hull, the floor surface remains exposed to serve as part of the boat's floor. Associated methods for manufacturing the boat and integrated floor and stringer system are also disclosed.

27 Claims, 6 Drawing Sheets

BOAT WITH INTEGRATED FLOOR AND STRINGER SYSTEM AND ASSOCIATED METHOD OF MANUFACTURING

CROSS REFERENCE TO RELATED APPLICATION

The present application is a divisional application of U.S. Application Serial No. 08/955,777 filed Oct. 22, 1997, now U.S. Pat. No. 6,032,606 which issued on Mar. 7, 2000.

BACKGROUND OF THE INVENTION

1. Field of the Invention

The present invention is related generally to boats and an associated method of manufacturing the same and, more particularly, to an integrated, molded floor and stringer system for positioning in the hull of a boat and an associated method of manufacturing the same.

2. Description of the Prior Art

It is known for boat constructions to employ the use of stringers to provide structural support to the boat. Stringers are typically longitudinal members constructed within the hull of the boat. The stringers provide structural support and stiffening to the hull and also provide support for the floor of the boat, which is typically constructed upon and attached to the stringers.

Conventional boat constructions required individually constructed stringers, usually made of wood or metal members, for forming the structural framing of the boat. Once the stringers were installed, then the floor surface was built upon the structural framing, i.e., the stringers, in order to provide for a complete boat construction. Constructing a boat in this manner was expensive, labor intensive and wasteful of valuable raw materials.

Present boat constructions may include stringer assemblies or stringer systems which are constructed separately from the hull and then positioned. As used herein, the term "unitary" means not assembled from a plurality of discrete components within the hull for providing structural support and stiffening of the hull. These type of stringer arrangements typically include one or more stringers with cross braces there between resulting in a complete structural framing that can be produced and installed more quickly and less expensively than conventional stringer constructions. Once installed in the hull, a floor surface may then be constructed upon the stringer system to complete the boat construction.

U.S. Pat. No. 3,848,284 sets forth a stringer system for boat hulls. This stringer systems includes one or more molded, synthetic foam beams. The stringer system provides stiffening and structural support for the hull, as well as, support for the floor which is constructed upon the stringer system following its insertion into the hull of the boat.

U.S. Pat. No. 4,021,874 is directed toward a boat hull having a body portion and a deck portion which are separately formed. The body portion includes structural supports formed therewith and the deck portion is then attached to the body portion and supported by the structural supports.

U.S. Pat. No. 4,821,667 sets forth a boat construction including a metal hull, comprised principally of a lightweight metal such as aluminum or steel, and an interior lining which is inserted into the hull. The structural configuration of the hull includes primarily a plurality of metal support beams and a longitudinally positioned beam. The interior lining is supported primarily on the hull along a mounting rim thereof. The interior lining serves, in part, as a part of the deck but is not an integral part of the structural configuration of the boat construction.

U.S. Pat. Nos. 5,433,165 and 5,526,767 are directed toward methods for manufacturing a boat hull. The boat hull may be formed of a fiber-reinforced polymer having a plurality of stringers embedded therein.

Their remains a need, however, for an improved stringer system which is less expensive, more easily installed and less wasteful of raw materials than presently known stringer systems.

SUMMARY OF THE INVENTION

The present invention has met the above described need by providing an integrated, molded floor and stringer system for insertion into the hull of a boat. The floor of the boat and the stringer system are integrally formed in order to reduce time and cost of construction and to provide increased structural support and stiffening to the hull of the boat.

A boat employing the concept of the present invention includes a molded hull and a molded floor and stringer system disposed in the hull. The floor and stringer system may include first and second stringers which, preferably, extend generally parallel to a longitudinal axis of the hull of the boat. Additionally, the first and second stringers are, preferably, generally symmetrical about a longitudinal axis of the floor and stringer system. The floor and stringer system also includes at least two bulkheads extending between the stringers. The bulkheads may be integrally molded with the floor and stringer system and provide for side-to-side support of the stringers, which in turn increases the lateral structural support provided by the floor and stringer system to the hull of the boat. Each of the stringers include a floor surface integrally molded therewith which remains exposed to act as the floor of the boat. By providing for a floor surface integrally molded with the stringers, it can be appreciated that construction time and overall cost of the floor and stringer system may be reduced in comparison to presently known stringer systems.

The floor and stringer system is preferably composed of a substantially rigid, fiberglass composite material. Each of the stringers may include first and second flange members formed to fit the hull of the boat. A bonding material, such as, a polyester bonding putty, may be placed between the first and second flange members and the hull for securing the floor and stringer system thereto. The floor and stringer system may also include a backwall which spans between the pair of stringers and extends generally upwardly therefrom. The backwall is preferably secured to the transom of the hull for further securing the floor and stringer system in position. Additionally, the floor surface and first and second flange members of the pair of stringers along with the hull may define a cavity which may be injected with a polyurethane foam to provide for additional structural support, flotation and sound deadening.

The floor and stringer system may also include a first opening between the first and second stingers to provide, for example, a storage compartment. A second opening may also be provided, for example, for housing a fuel tank. The floor and stringer system may also include a molded depression located between the pair of stringers for housing the engine of the boat.

A method for manufacturing the floor and stringer system of the present invention generally includes: (1) providing a mold with an outer surface shaped in the configuration of the floor and stringer system; (2) applying a release agent to the mold; (3) applying a layer of gelcoat to the release agent which will provide a smooth, colored exterior finish for the floor and stringer system; (4) applying a first layer of fiberglass composite material to the gelcoat; (5) applying a layer of knitted fabric to the first layer of fiberglass; and (6) applying a second layer of fiberglass composite material to securely retain the layer of knitted fabric in place. The first and second layers of fiberglass composite material may each include a mixture of a resin binder, a catalyzing agent and chopped fiberglass strands.

A method of manufacturing a boat employing the concepts of the present invention generally may include: (1) providing a molded hull; (2) providing a molded floor and stringer system where the molded floor and stringer system may include first and second stringers having a floor surface integrally molded therewith; (3) positioning the molded floor and stringer system within the molded hull; and (4) securing the molded floor and stringer system to the molded hull.

It is, therefore, an object of the present invention to provide an integrated, molded floor and stringer system for positioning in the hull of a boat for providing stiffening and structural support to the hull of the boat.

It is a further object of the present invention to provide a floor and stringer system having the stringers integrally formed with a floor surface to serve as the floor of the boat once the floor and stringer system is positioned within the hull.

It is also an object of the present invention to provide a boat having a molded hull with an integrated, molded floor and stringer system contained therein.

It is yet another object of the present invention to provide a method of manufacturing an integrated floor and stringer system for positioning in the hull of a boat.

Still yet another object of the present invention is to provide a method of manufacturing a boat having a molded hull and integrated, molded floor and stringer system for positioning therein so as to provide stiffening and structural support to the molded hull of the boat.

It is another object of the present invention to provide an integrated floor and stringer system which is molded of a substantially rigid, fiberglass composite material.

These and other objects of the invention will be more fully understood from the description of the invention with reference to the drawings appended hereto.

DESCRIPTION OF THE PREFERRED EMBODIMENT

As used herein, the term "contact" or "contacting" means either direct contact or contact where an intermediate member or material may be positioned therebetween.

Figure 1:
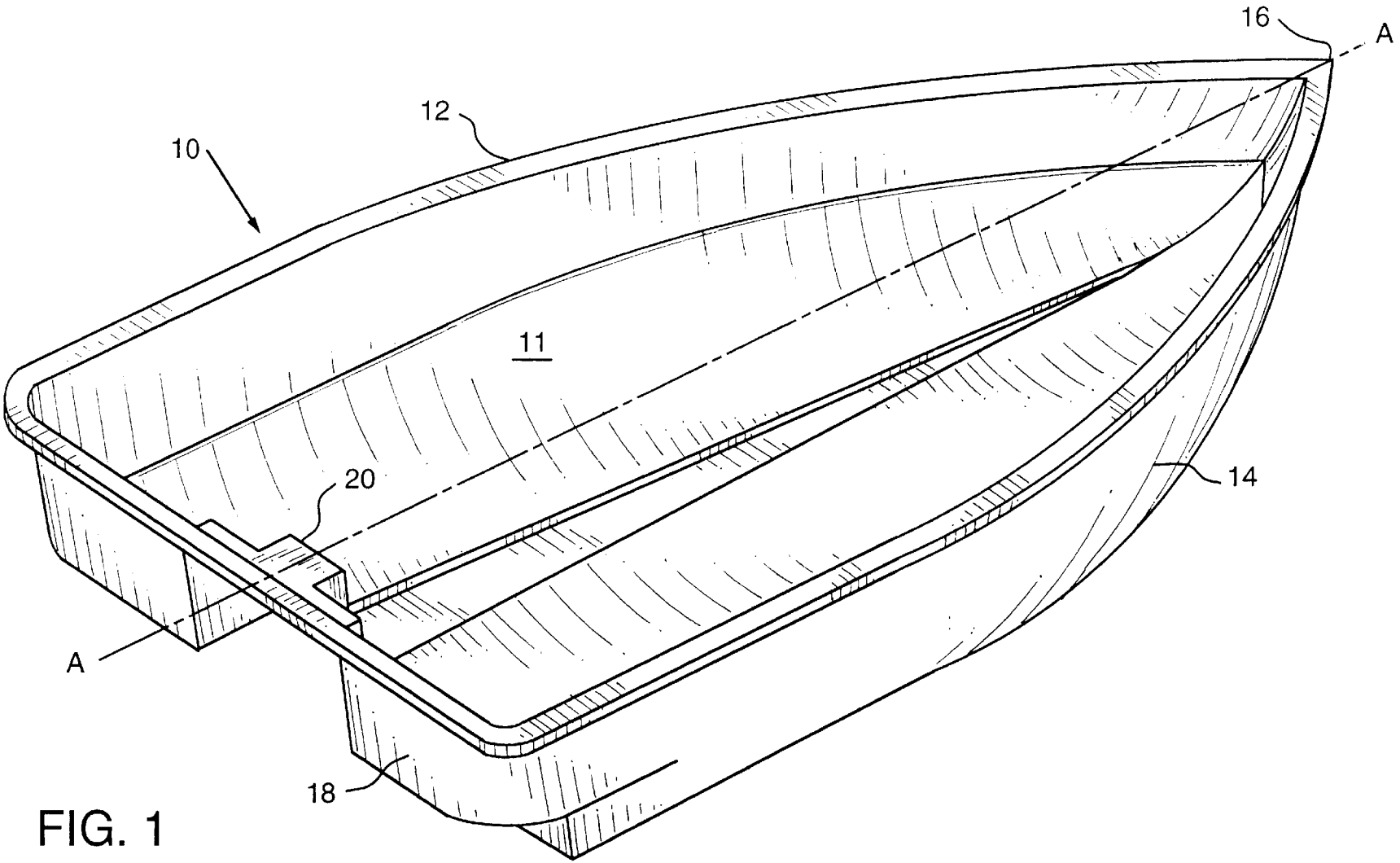
FIG. 1 is a perspective view of a boat hull.

Referring to FIG. 1, there is shown a boat hull 10 for use in conjunction with the present invention. The hull 10 may be of any conventional size or shaped hull and constructed in a manner as is known in the art, preferably molded. The hull 10 may include a port side 12, a starboard side 14, a bow 16, and stern 18 having a transom 20 extending across the stern 18 for providing structural support to the hull 10. The hull 10 has an interior surface 11. Line A represents a longitudinal axis of hull 10.

Figure 2:
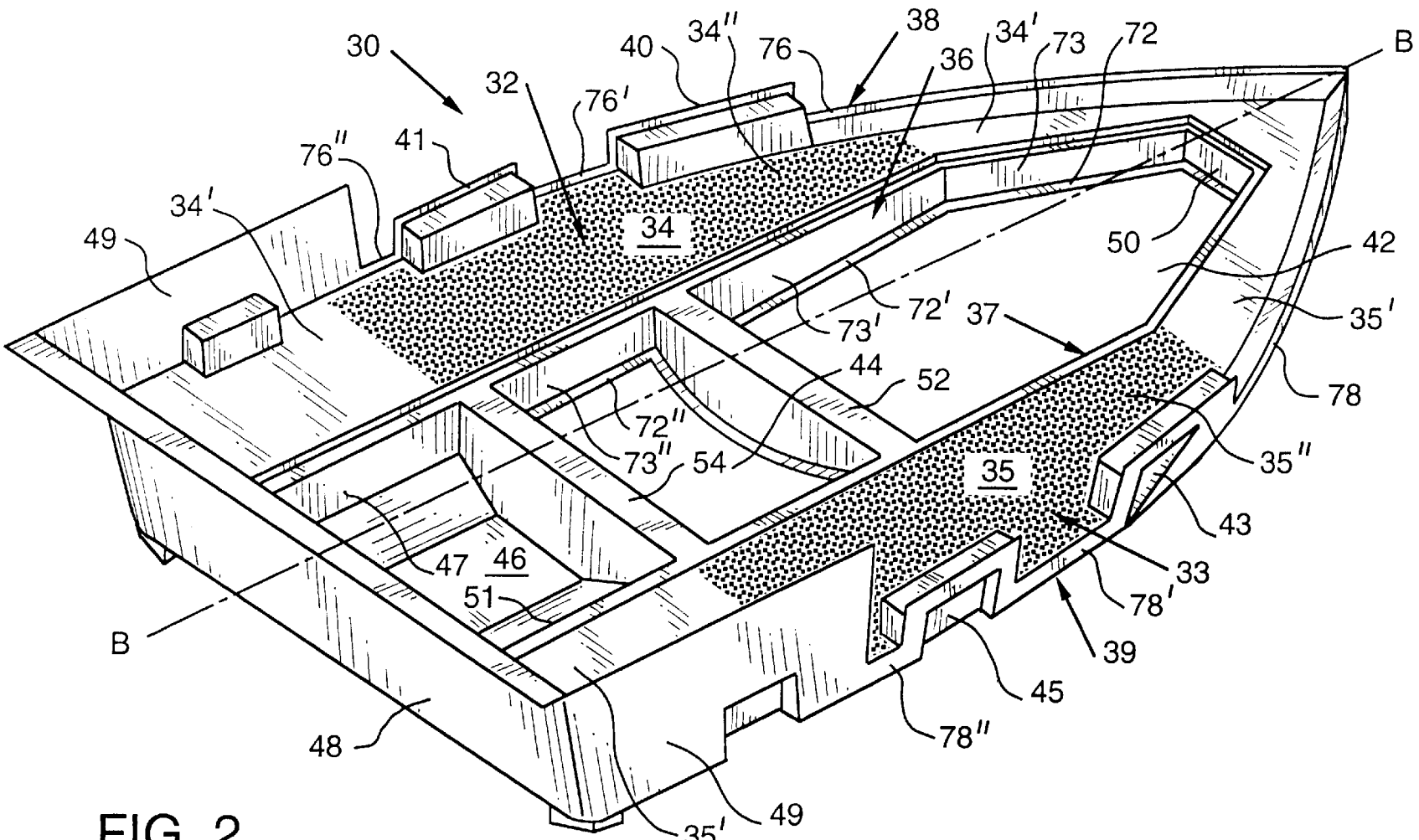
FIG. 2 is a perspective view of an integrated floor and stringer system of the present invention showing the top side thereof.
Figure 3:
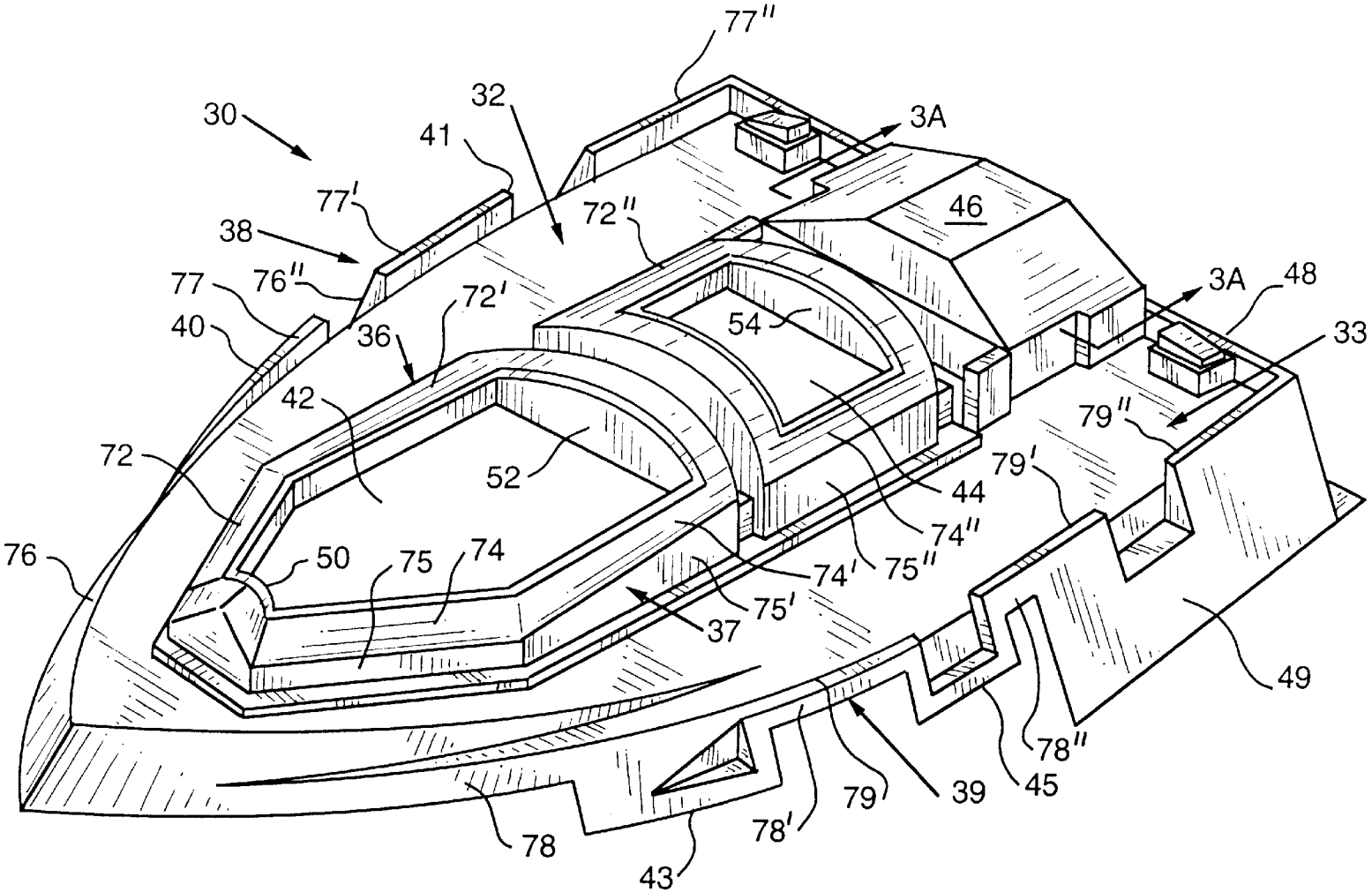
FIG. 3 is a perspective view of the integrated floor and stringer system of FIG. 2 showing the bottom side thereof.
Figure 5A:
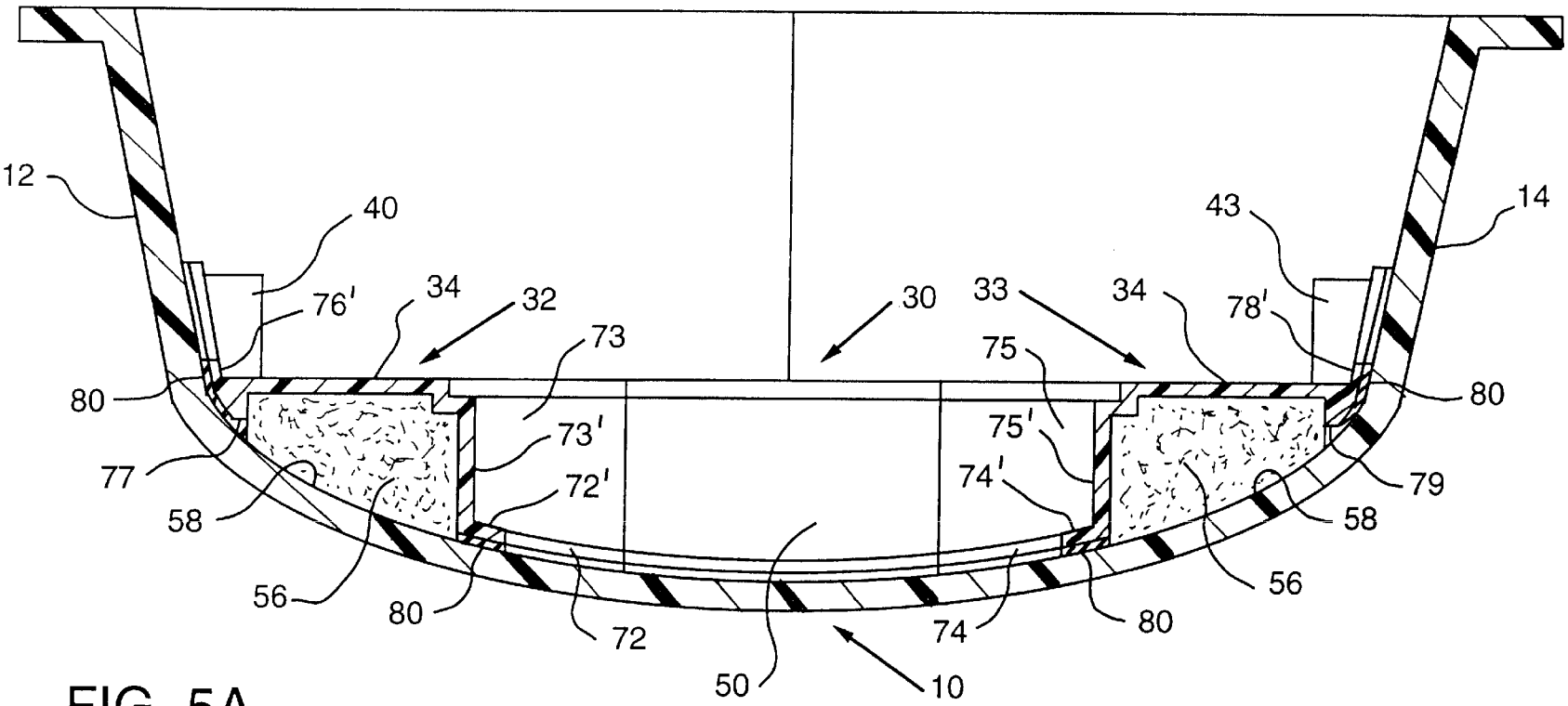
FIG. 5A is a sectional view taken along line 5A—5A of FIG. 5.
Figure 5:
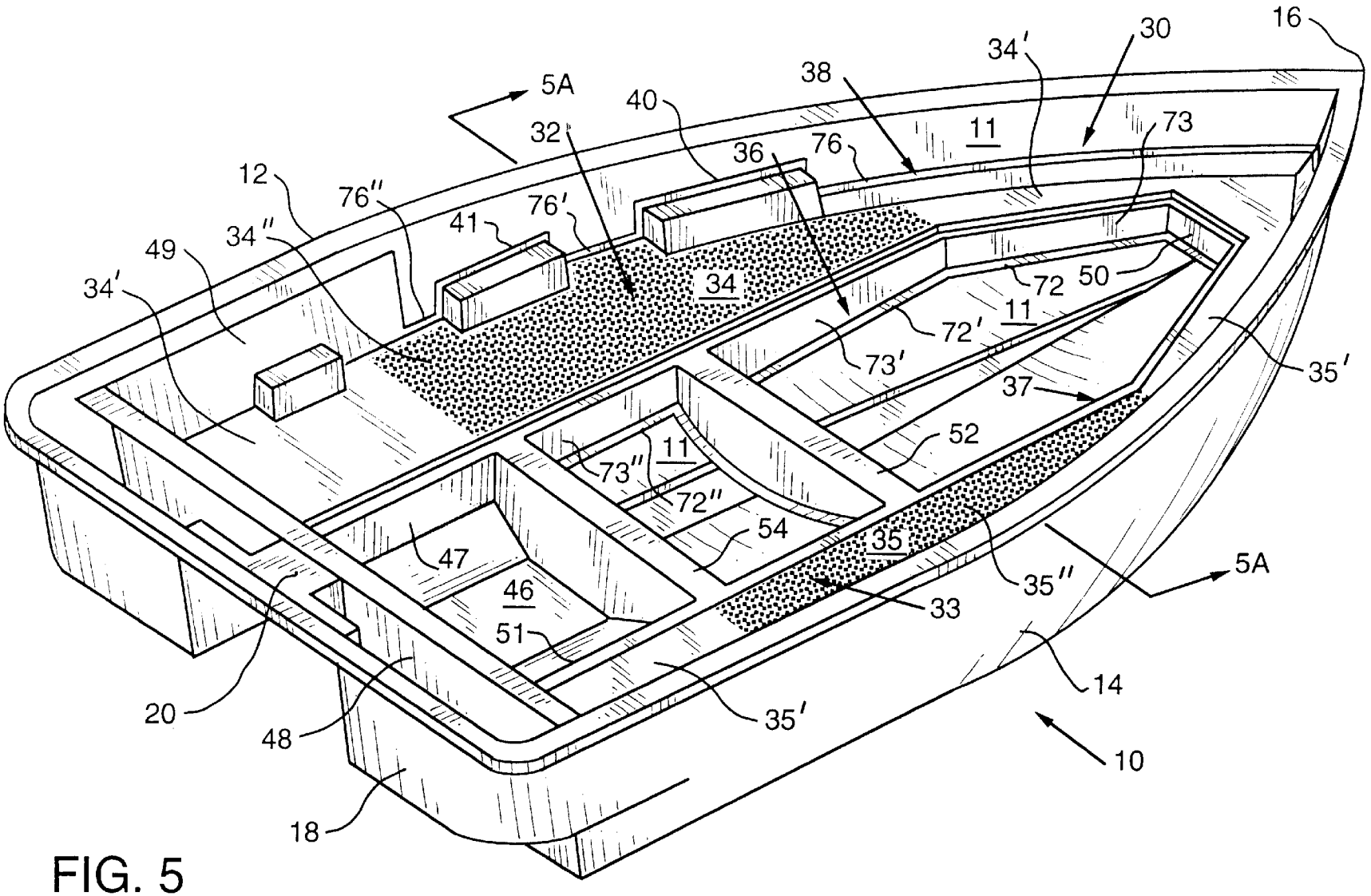
FIG. 5 is a top plan view showing the hull of FIG. 1 with the integrated floor and stringer system of FIGS. 2 and 3 disposed therein.

Referring to FIGS. 2 and 3, there is shown an integrated floor and stringer system, generally indicated by reference numeral 30, of the present invention. The floor and stringer system 30 may be disposed within the interior of the hull 10, as shown in FIGS. 5 and 5A and as will be described in detail hereinbelow, for providing structural support and stiffening of the hull 10 and for providing a floor surface for a boat following insertion of the floor and stringer system 30 into the hull 10. The floor and stringer system 30 is preferably composed of a substantially rigid, fiberglass composite material. The floor and stringer system 30 may include first and second stringers, generally indicated by reference numerals 32, 33 respectively. Preferably, the stringers 32, 33 are generally symmetrical about a longitudinal axis, as represented by line B, of the floor and stringer system 30.

As further shown in FIG. 2, stringer 32 includes a floor surface 34 which is, preferably, generally horizontal. Stringer 32 also includes a first flange member and second flange member, generally indicated by reference numerals 36,38 respectively, that are unitary with the floor surface 34 such that the stringer 32 is free of joints. Similarly, stringer 33 also includes a, preferably, generally horizontal floor surface 35, and a first flange member and second flange member, generally indicated by reference numerals 37, 39 respectively, that are unitary with the floor surface 35 such that the stringer 33 is free of joints.

Referring to FIGS. 2 and 3, first flange member 36 of stringer 32 includes contact members 72,72',72" for contacting the interior surface 11 of the hull 10 and support members 73,73',73" extending between the floor surface 34 and contact members 72,72',72" respectively. Similarly, first flange member 37 of stringer 33 includes contact members 74,74',74" and support members 75,75',75". Second flange member 38 of stringer 32 includes first contact edges 76,76',76" and second contact edges 77,77',77" for contacting the interior 11 of hull 10 and, similarly, second flange member 39 of stringer 33 includes first contact edges 78,78',78" and second contact edges 79,79',79" for also contacting the interior 11 of hull 10. Second flange members 38, 39 may also include pods 40, 41 and pods 43,45 respectively, extending upwardly therefrom. Pods 40, 41 and pods 43,45 provide for additional contacting surfaces between stringers 32, 33 and the interior surface 11 of hull 10. Pods 40, 41 and pods 43,45 also provide additional stiffness and structural support to the hull 10. Pods 40, 41 and pods 43,45 additionally may serve for mounting various boat components, such as, decorative side panels, for the completed boat structure as is generally known in the art.

In a preferred embodiment, as shown in FIGS. 2 and 5, the floor surfaces 34,35 may be molded so as to have smooth portions 34',35' and/or textured portions 34" and 35". The textured portions 34",35" of floor surfaces 34,35 may be textured so as to have a design, pattern or shape that effectively provides for a suitable floor surface but resists skidding by users of the floor surface. It should be appreciated, however, that the floor surfaces 34,35 may also be molded with a completely smooth surface and then a non-skid material or surface applied thereto, as is known.

The floor and stringer system 30 may also include a first opening 42 and a second opening 44 formed between the stringers 32, 33. The first opening 42 may serve, for example, as a storage area for storing commonly known boating equipment, such as, skis and life jackets. The second opening 44 may serve, for example, as a location for mounting additional components of the boat, such as, for example, a fuel tank.

Figure 3A:
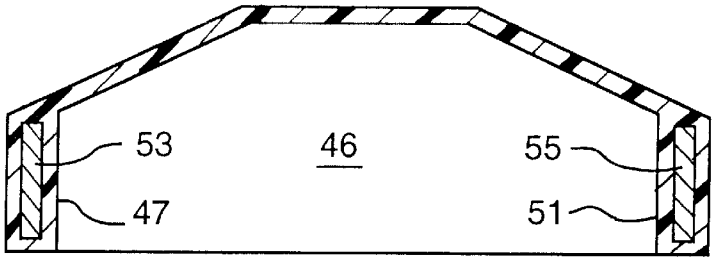
FIG. 3A is a sectional view taken along line 3A—3A of FIG. 3.

The floor and stringer system 30 also may include a molded depression 46 formed between the stringers 32, 33. The molded depression may serve, for example, as a location for mounting and housing the boat's engine. The molded depression 46 is formed so as to have at least one wall, such as first wall 47 and second wall 51. As shown in FIG. 3A, first wall 47 and second wall 51 of the molded depression 46 may include a mounting plate 53 and a mounting plate 55, respectively, molded therein. The mounting plates 53,55 are preferably composed of a metal, such as, for example, aluminum, and the mounting plates 53,55 preferably have a thickness in the range of about 0.1 to 0.5 inches. The mounting plates 53,55 are molded within the first wall 47 and second wall 51 respectively so as to provide for increased support when mounting, for example, the boat's engine in the molded depression 46. For example, holes may be drilled through first wall 47 and second wall 51 and into mounting plates 53,55 so that engine mounts may be connected thereto (not shown). It should be appreciated that mounting plates may be molded within other walls or areas of molded depression 46 as well, if desired.

Still referring to FIGS. 2 and 3, the floor and stringer system 30 may further include a backwall 48 formed between the stringers 32, 33 and extending generally upwardly therefrom. Preferably, the backwall 48 is formed adjacent the molded depression 46 and serves to further enclose the boat component, such as the engine, which is housed within the molded depression 46. The backwall 48 may also be secured to the transom 20 in order to further secure the floor and stringer system 30 to the hull 10. The floor and stringer system 30 may also include sidewalls 49 extending generally upwardly from the stringers 32, 33.

The floor and stringer system 30 may also include bulkheads 50,52,54 which extend between the stringers 32, 33. The bulkheads 50, 52, 54 are preferably integrally formed with the floor and stringer system 30. The bulkheads 50, 52, 54 provide structural support between the stringers 32, 33 which in turn provides structural support to the hull 10. Bulkhead 50 may be positioned between stringers 32, 33 adjacent the end of the floor and stringer system 30 where the stringers 32, 33 merge together. Bulkhead 52 may be provided between the first opening 42 and second opening 44, and bulkhead 54 may be located between the second opening 44 and the molded depression 46.

The floor and stringer system 30 of the present invention is preferably molded, and more preferably open molded, so that the end result is a composite, integrated floor and stringer system 30 for positioning in the hull 10. As can be appreciated, the floor and stringer system 30 is a complete floor and stringer construction ready for insertion into the hull 10 once the molding is completed.

Figure 4:
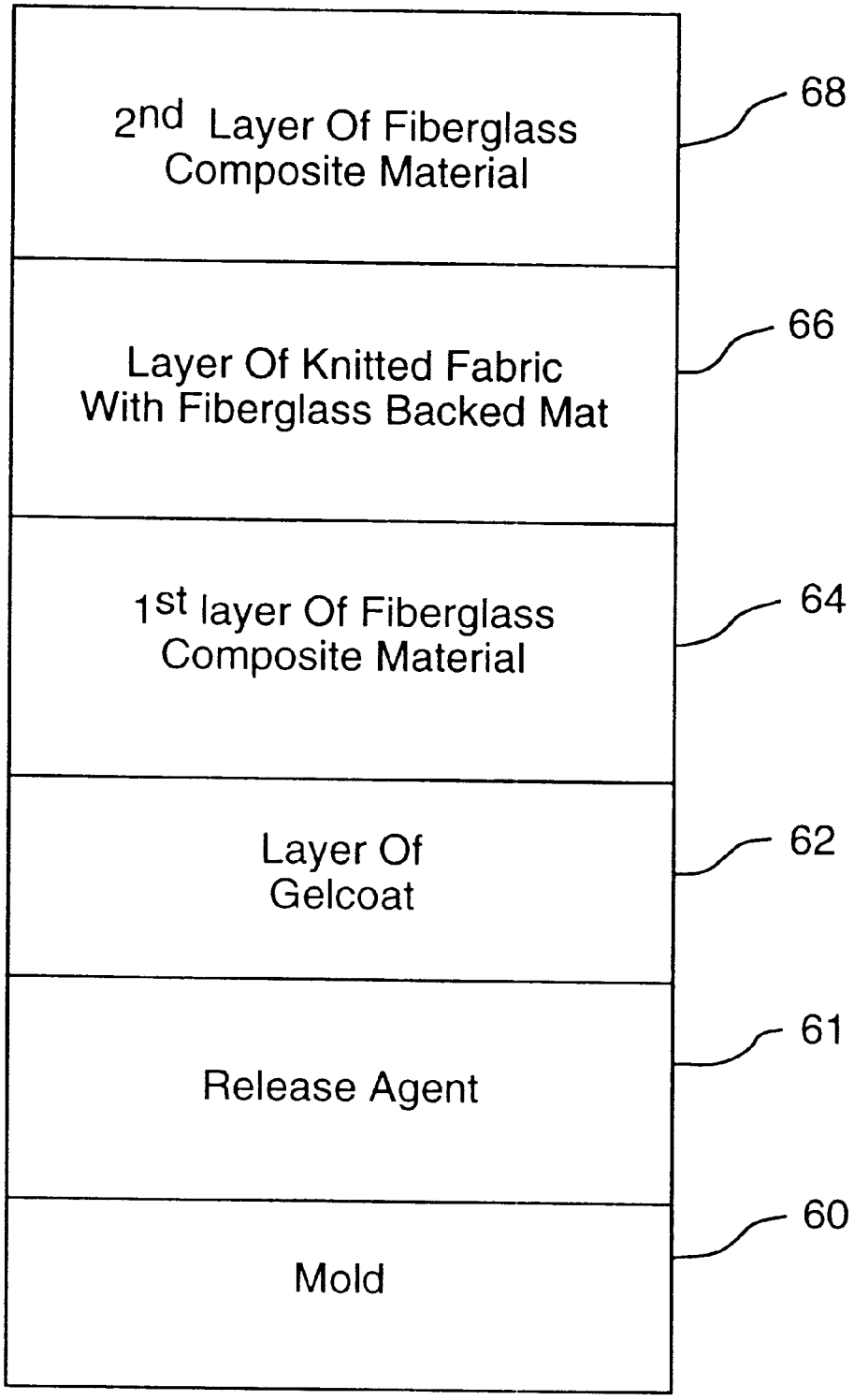
FIG. 4 is a block diagram setting forth a lamination schedule for molding the integrated floor and stringer system of the present invention.

As shown in FIG. 4, a method of manufacturing a floor and stringer system 30 of the present invention generally includes as a first step providing a mold 60 having an outer surface shaped in the configuration of the floor and stringer system 30. Secondly, the method includes applying a release agent 61 to the mold 60. The release agent 61 aids in releasing the floor and stringer system 30 from the mold 60 once the molding is completed. The release agent 61 may be, for example, Solo as marketed by FREKOTE and may either be sprayed on to the mold or wiped on, as is known.

The method next includes applying gelcoat 62 to the release agent 61. The layer of gelcoat 62 may be applied by a spraying application in a manner as is known in the art. The layer of gelcoat 62 preferably has a thickness in the range of about 18.0 to 20.0 mils. The layer of gelcoat 62 provides a smooth, colored exterior finish for the floor and stringer system 30 once the floor and stringer system 30 is removed from the mold 60. Once the gelcoat is applied, the gelcoat may be allowed to cure preferably at ambient temperature. The curing time for the gelcoat is preferably 45 to 90 minutes.

The method next includes applying a first layer of fiberglass composite material 64 to the layer of gelcoat 62. The first layer of fiberglass composite material 64 preferably is composed of a resin binder, a catalyzing agent, and chopped fiberglass strands. The resin binder may be, for example, Ashland AROPOL Q 6315 and the catalyzing agent may be, for example, LUPERSOL DDM-9. The chopped fiberglass strands contained in the first layer of fiberglass 64 preferably have a length of about 1.0 to 1.5 inches. As is known, the layer of fiberglass 64 composed of the resin binder, catalyzing agent and chopped fiberglass strands may be sprayed onto the previously applied layer of gelcoat 62. Preferably, the layer of fiberglass 64 is composed of, by weight percentage, 58.8% resin, 40% fiberglass and 1.2% catalyzing agent. The first layer of fiberglass composite material 64 preferably has a thickness in the range of about 50.0 to 60.0 mils.

The method next includes applying a layer of knitted fabric 66. The layer of knitted fabric 66 preferably includes a fiberglass backed mat and may be, for example, DBM 1708 KNYTEX X-MAT as marketed by OWENS CORNING. The layer of knitted fabric 66 serves as a reinforcement material to the laminated construction of the floor and stringer system 30 and provides extra strength and support to the floor and stringer system 30 once the molding is completed. The layer of knitted fabric 66 preferably has a thickness in the range of about 50.0 to 55.0 mils.

The method then includes applying a second layer of fiberglass composite material 68. This second layer of fiberglass 68 is similar to the first layer of fiberglass 64 and is also composed of a mixture of resin binder, a catalyzing agent and chopped fiberglass strands. The chopped fiberglass strands contained in the second layer of fiberglass 68 preferably have a length in the range of about 1.0 to 1.5 inches. Preferably, the layer of fiberglass 64 is composed of, by weight percentage, 58.8% resin, 40% fiberglass and 1.2% catalyzing agent. The second layer of fiberglass 68 preferably has a thickness in the range of about 40.0 to 50.0 mils.

Once the layers have been laid up on the mold 60 as shown in FIG. 4, the floor and stringer system 30 may be allowed to cure prior to removing from the mold 60. The floor and stringer system 30 is preferably cured at ambient temperature. The curing time for the floor and stringer system 30 is preferably in the range of about 3 to 4 hours. Following the curing of the floor and stringer system 30, the floor and stringer system 30 may then be removed from the mold 60 in a manner as is known.

The method may also include molding at least a portion of the floor surfaces 34,35 of the floor and stringer system 30 so as to have textured portions 34",35" as described herein above. This is preferably accomplished by providing at least a portion of mold 60 that forms the floor surfaces 34,35 with a textured design, pattern or shape which results in the floor surfaces 34,35 having textured is portions 34",35" with the same textured design, pattern or shape following completion of the molding process.

The present method may also include molding mounting plates 53,55 into first wall 47 and second wall 51, respectively, of molded depression 46, as shown in FIG. 3A and described herein above. The mounting plates 53,55 are preferably inserted during the molding process following applying the layer of knitted fabric 66 and prior to applying the second layer of fiberglass 68, although it should be appreciated that the mounting plates 53,55, or additional mounting plates, may be inserted between other layers during the molding process.

Referring to FIGS. 5 and 5A, there is shown the floor and stringer system 30 of the present invention as positioned in the interior of hull 10. A method of manufacturing a boat having the floor and stringer system 30 disposed in the hull 10 includes the first step of providing the hull 10, which is preferably molded in a manner as is known in the art. The method next includes providing the molded floor and stringer system 30 as described in detail herein. The method then includes positioning the molded floor and stringer system 30 into the molded hull 10 and securing the floor and stringer system 30 to the hull 10.

Referring specifically to FIG. 5A, the molded floor and stringer system 30 may be secured to the interior surface 11 of the hull 10 by providing a layer of bonding material therebetween. For example, the bonding material may be a polyester bonding putty 80, such as, Bonding Putty 4896 as marketed by Lilly Industries, Inc. The polyester bonding putty 80 may be placed on the interior surface 11 of the hull 10 at locations where the contact members 72,72',72" and contact members 74,74',74" are to contact the interior 11, as well as, where first contact edges 76,76',76" and 78,78',78" and second contact edges 77,77',77" and 79,79',79" are to contact the interior surface 11. This insures that the floor and stringer system 30 is effectively secured to the hull 10. The polyester bonding putty 80 may also be applied to the interior surface 11 at all locations where the pods 40, 41 and pods 43,45 are to be in contact therewith.

Preferably, the bonding material is allowed to cure for about 45 to 60 minutes. Also, the curing preferably takes place at ambient temperature.

Once the floor and stringer system 30 is secured to the hull 10, a layer of the knitted fabric 66 may then be applied so as to overlap points of contact between the floor and stringer system 30 and the interior surface 11 of the hull 10. This layer of knitted fabric 66 further effectively secures the floor and stringer system 30 to the hull 10 and preferably has a thickness of about 50.0 to 55.0 mils.

The method may also include injecting a layer of polyurethane foam 56 into a cavity 58 formed beneath the floor surfaces 34, 35 and above the interior surface 11 of the hull 10. The layer of polyurethane foam 56 provides additional structural support, improved floatation, and sound deadening, as is known in the art.

It will be appreciated, therefore, that the present invention provides a unique integrated floor and stringer system for insertion into the hull of a boat and method of manufacturing the same. By integrally forming the floor and stringer system, construction time and construction costs of the system may be reduced while still providing an effective system for structurally supporting and stiffening the hull of the boat.

Whereas particular embodiments of the invention have been described above for purposes of illustration, it will be appreciated by those skilled in the art that numerous variations of the details may be made without departing from the invention as described in the appended claims.

What is claimed is:

1. A boat comprising:

a molded hull;

a molded floor and stringer system disposed in the hull;

said molded floor and stringer system including first and second stringers;

said molded floor and stringer system further including at least two bulkheads extending between said first and second stringers;

said first and second stringers each including an integrally molded floor surface; and said molded floor and stringer system being a unitary one piece member that is free of joints between said floor surfaces and said first and second stringers.

2. The boat of claim 1 wherein said molded floor and stringer system is composed of a substantially rigid, fiberglass composite material.

3. The boat of claim 1 further including securing means for securing said molded floor and stringer system to the hull.

4. The boat of claim 3 wherein said securing means includes a polyester bonding putty.

5. The boat of claim 3 wherein said securing means includes one or more layers of knitted fabric.

6. The boat of claim 1 wherein said molded floor and stringer system includes a first opening between said first and second stringers.

7. The boat of claim 6 wherein said molded floor and stringer system includes a second opening between said first and second stringers.

8. The boat of claim 7 wherein said molded floor and stringer system includes a molded depression formed between said first and second stringers.

9. The boat of claim 8 wherein said molded depression includes at least one wall, said at least one wall having a mounting plate molded therein.

10. The boat of claim 9 wherein said mounting plate is composed of aluminum.

11. The boat of claim 9 wherein said mounting plate has a thickness in the range of about 0.1 to 0.5 inches.

12. The boat of claim 1 wherein said first and second stringers are generally symmetrical about a longitudinal axis of said molded floor and stringer system.

13. The boat of claim 1 wherein said floor surface is generally horizontal.

14. The boat of claim 1 wherein said first and second stringers extend generally parallel to a longitudinal axis of the molded hull.

15. The boat of claim 1 wherein said floor surface is molded so as to have a textured portion.

16. A molded floor and stringer system for positioning in the hull of a boat comprising:

first and second stringers;

at least two bulkheads extending between said first and second stringers;

said first and second stringers each including an integrally molded floor surface; and said molded floor and stringer system being a unitary one piece member that is free of joints between said floor surfaces and said first and second stringers, whereby the unitary one piece member is structured to be unitarily introduced into and secured in the hull of the boat.

17. The molded floor and stringer system of claim 16 wherein said pair of stringers are composed of a substantially rigid, fiberglass composite material.

18. The molded floor and stringer system of claim 16 further including a first opening between said first and second stringers.

19. The molded floor and stringer system of claim 18 further including a second opening between said first and second stringers.

20. The molded floor and stringer system of claim 19 further including a molded depression formed between said first and second stringers.

21. The molded floor and stringer system of claim 20 wherein said molded depression includes at least one wall, said at least one wall having a mounting plate molded therein.

22. The molded floor and stringer system of claim 21 wherein said mounting plate is composed of aluminum.

23. The molded floor and stringer system of claim 21 wherein said mounting plate has a thickness in the range of about 0.1 to 0.5 inches.

24. The molded floor and stringer system of claim 16 further including a backwall spanning between said first and second stringers and extending generally upwardly therefrom.

25. The molded floor and stringer system of claim 16 wherein said first and second stringers are generally symmetrical about a longitudinal axis of said molded floor and stringer system.

26. The molded floor and stringer system of claim 16 wherein said floor surface is generally horizontal.

27. The molded floor and stringer system of claim 16 wherein said floor surface is molded so as to have a textured portion.

* * * * *